US005449872A

United States Patent [19]

Wilson

[11] Patent Number: 5,449,872

[45] Date of Patent: Sep. 12, 1995

[54] COMPACT ROTARY SWITCHING ASSEMBLY

[75] Inventor: Robert F. Wilson, Vancouver, Canada

[73] Assignee: MPR Teltech Ltd., Canada

[21] Appl. No.: 177,170

[22] Filed: Jan. 4, 1994

[51] Int. Cl.[6] ..... H01H 3/20

[52] U.S. Cl. ..... 200/518; 200/336; 200/338; 200/573; 200/572

[58] Field of Search ..... 200/518, 564, 572, 336, 200/337, 338, 573, 574, 331; 74/25

[56] References Cited

U.S. PATENT DOCUMENTS 2,919,334 12/1959 Jones ..... 200/331
3,009,029 11/1961 Bodenschatz et al. ..... 200/331 X
3,939,725 7/1976 Fisher ..... 200/331
4,000,382 12/1976 Kolb ..... 200/572 X
4,745,243 5/1988 Wang ..... 200/331

FOREIGN PATENT DOCUMENTS 284189 10/1962 Netherlands ..... 200/572

*Primary Examiner*—Ernest G. Cusick
*Attorney, Agent, or Firm*—Vinson & Elkins

[57] ABSTRACT

A rotary switch which includes a rotary actuator, a linear switch having a linear actuator and a rotary to linear translator interconnecting the rotary actuator to the linear actuator. Rotation of the rotary actuator causes the translator to move linearly and, in turn, to move the linear actuator.

7 Claims, 5 Drawing Sheets

COMPACT ROTARY SWITCHING ASSEMBLY

FIELD

The present invention relates to a compact rotary switching assembly for converting rotary motion to movement of a linear switch to different switch positions.

BACKGROUND

Often standard rotary switches are a more desirable type of switch than linear switches because their type of motion permits a user to move the switch more easily through different switch positions without inadvertently stopping at an undesired position. However, in order to switch a given mount of current, rotary switches of a size much larger than linear switches are required. Thus, in order to switch a given amount of current, conventional rotary switches take up a much greater area of circuit board space than would linear switches and are often not compatible with the compact arrangement of components on a circuit board that is generally required. Linear switches having multiple switch positions can be obtained which are significantly more narrow and less expensive than rotary switches but are not convenient to operate. Thus, there is a need for a mechanical switch which combines the size advantages of a linear switch and the convenience of a rotary switch.

Accordingly, it is an object to provide an improved rotary switch which takes up less circuit board space than a conventional rotary switch of the same current carrying capacity.

SUMMARY OF THE INVENTION

According to a preferred embodiment of the invention there is provided a rotary actuator, a linear switch having a linear actuator and a rotary to linear translator interconnecting the rotary actuator to the linear actuator such that rotation of the rotary actuator causes the translator to move linearly and move the linear actuator.

Advantageously, the rotary actuator includes a rotary switch knob and a rotary to linear actuator coupled to the knob at one end and to the rotary to linear translator at another end.

Preferably, the rotary to linear translator is an elongated plate. A spring clip may engage the linear actuator and bias it to a preselected position wherein the elongated plate is sufficiently loose so that, upon movement of the linear actuator towards the preselected position, a point is reached at which the spring clip takes control of movement of the linear actuator and moves it to the preselected position.

The rotary to linear actuator may include a pin mounted in a fixed position, a rod coupled to the rotary knob at one end and having a pin receptacle at another end slidably receiving the pin so that upon rotation of the knob, the rod also rotates while maintaining alignment with the switch knob.

BRIEF DESCRIPTION OF THE DRAWINGS

The novel features believed characteristic of the invention are set forth in the appended claims. The invention itself, as well as other features and advantages thereof, will be best understood by reference to the description which follows read in conjunction with the accompanying drawings, wherein:

DETAILED DESCRIPTION WITH REFERENCE TO THE DRAWINGS

Figure 1:
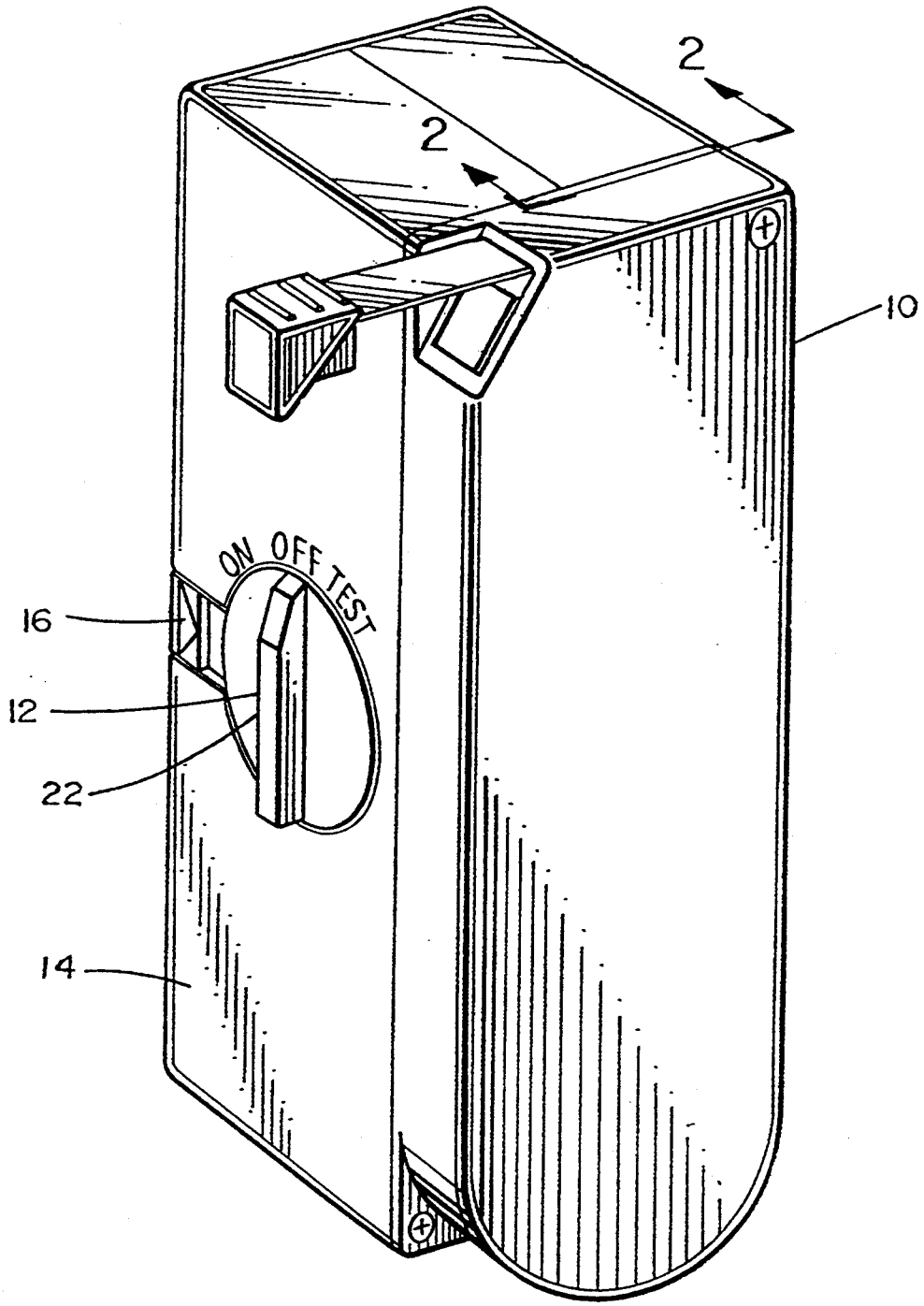
FIG. 1 is perspective view of a miniature emergency position indicating radio beacon which employs the rotary switch of the present invention.

Referring to FIG. 1, there is shown a miniaturized emergency position indicating radio beacon 10 as made by MPR Teltech Ltd. of Burnaby, British Columbia, Canada. A rotary switch knob 12 of a rotary switch 22 is mounted in the casing 14 thereof. A lock 16 is biased toward the switch knob 12 and serves to maintain the switch knob 12 either locked into an ON position or, if the switch is in other than the ON position, locked so that it can not enter the ON position.

Figure 2:
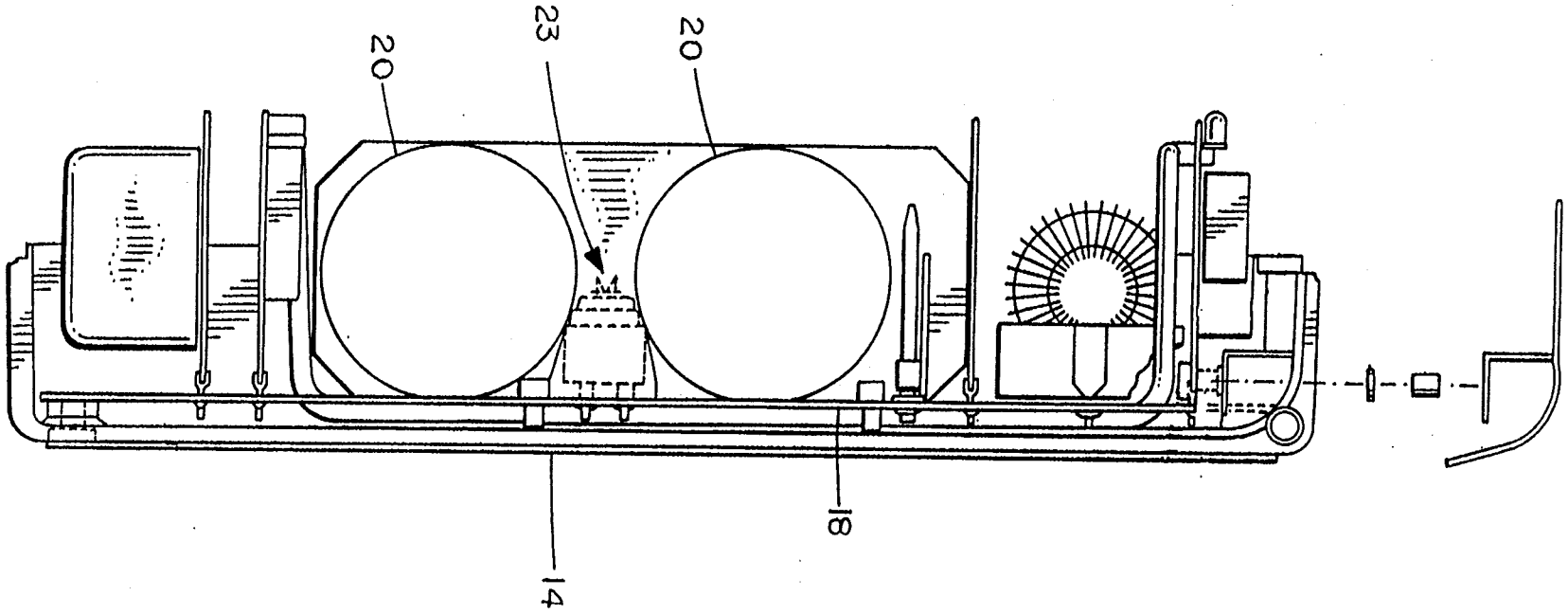
FIG. 2 is a side elevation view of the device of FIG. 1 with one half of the casing removed and taken along the line 2—2, showing the configuration constraints on the location of a rotary switch in the device of FIG. 1.

Referring to FIG. 2 there is shown in elevation the beacon 10 with half of the casing 14 removed. Mounted on a circuit board 18 are a number of components including two large batteries 20. The only location available for mounting a rotary switch 22 is in the space 23 between the batteries 20. Such a space is too small for a conventional rotary switch given the current switching requirements. However, a three position linear switch will fit at this location.

Figure 3:
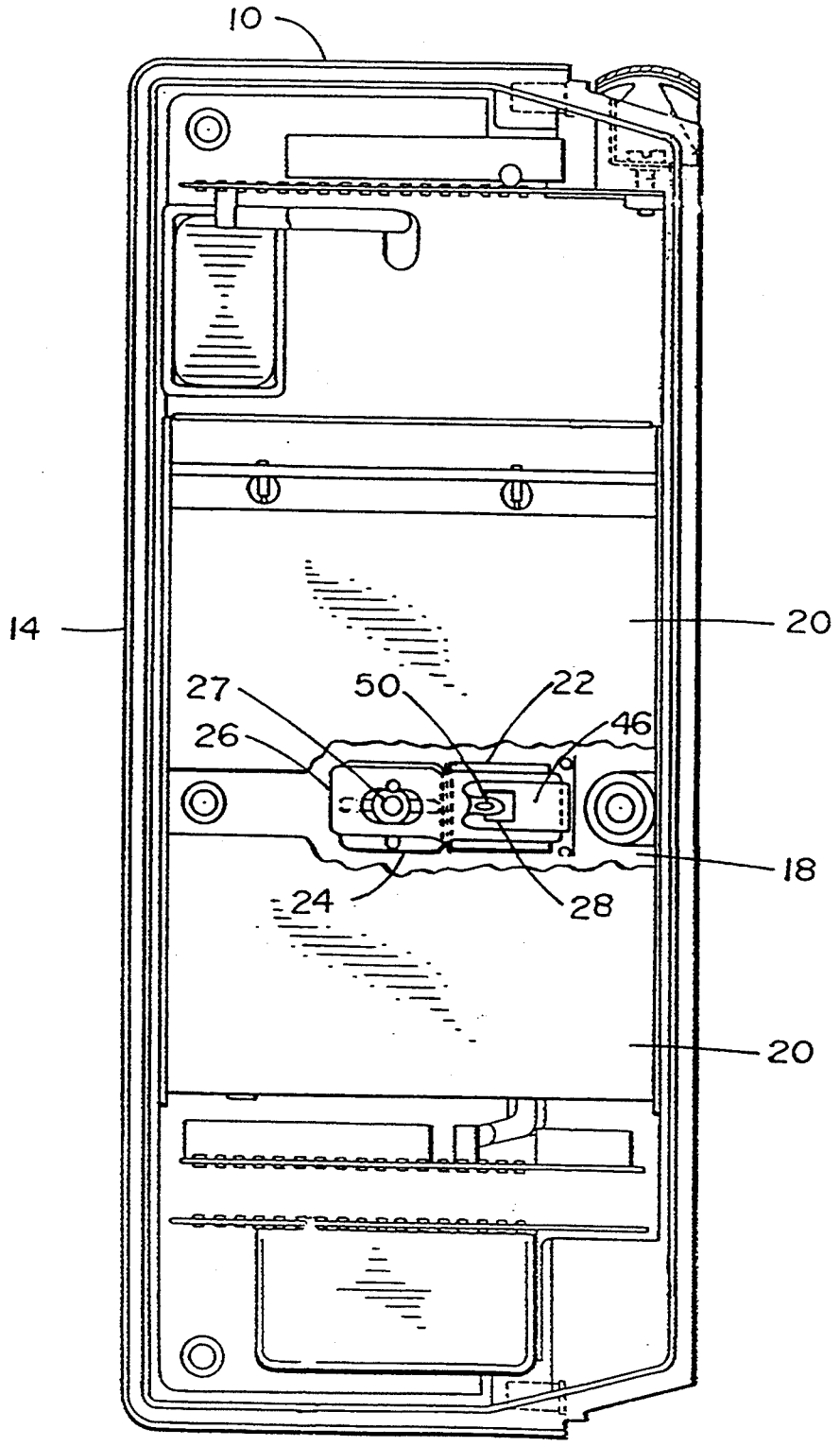
FIG. 3 is a top view of the casing of FIG. 2, showing the rotary switch of the present invention.
Figure 4:
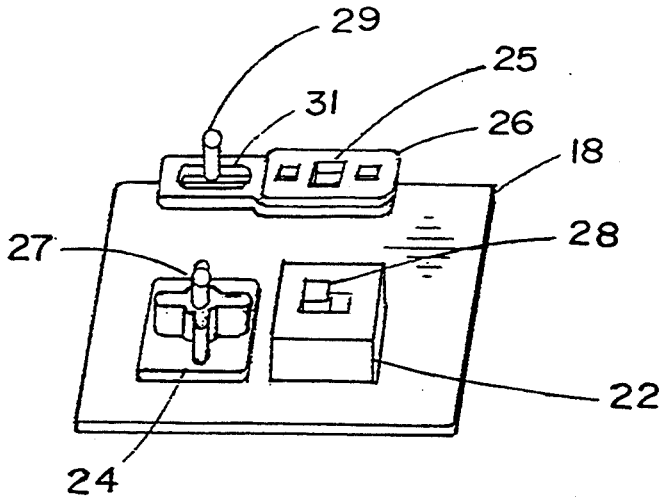
FIG. 4 is a perspective view of the elongated plate, base and linear switch in exploded form.
Figure 6:
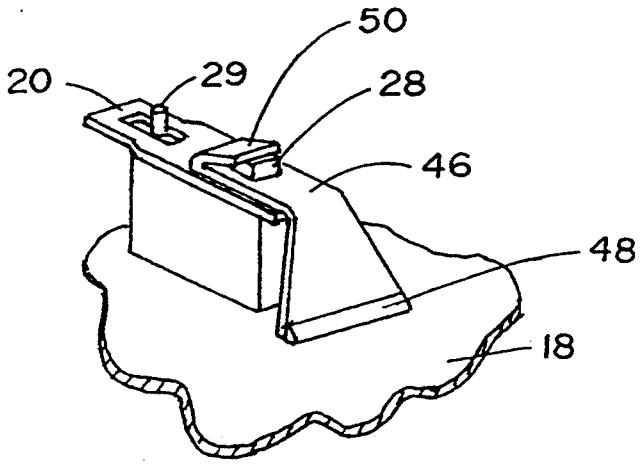
FIG. 6 is a perspective view of the linear switch with a spring clip for biasing the switch to a central position.
Figure 7:
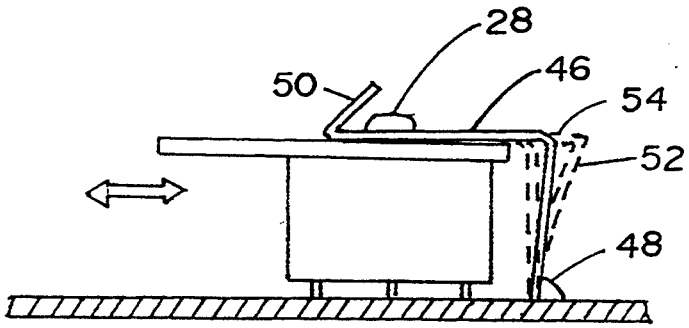
FIG. 7 is a side elevation view of the linear switch and spring clip.

Referring to FIG. 3 and FIG. 4 there is shown a top view of the layout of the batteries 20 and switch 22 mounted on circuit board 18. Adjacent switch 22 is mounted a base 24 which has a centrally positioned boss 27. Base 24 is coupled to switch 22 by means of a elongated plate 26 which operates a linear switch actuator 28 of switch 22. Elongated plate 26 also has a rod 29 located on one side of an elongated slot 31 and a rectangular opening 25 which fits loosely over linear switch actuator 28 leaving longitudinal play of the elongated plate 26 relative to the linear switch actuator 28. A spring clip 46 has one end which is soldered to the printed circuit board 18 by a bead of solder 48 (see FIGS. 6 and 7) and is bent over onto elongated plate 26 such that an opening in the spring clip fits over the linear switch actuator 28 and a tab 50 is bent back from clip 46 and engages linear switch actuator 28. Clip 46 is soldered in place when linear switch actuator 28 is in a central OFF position. Movement of linear switch actuator 28 away from its central position is against the biasing force of spring clip 46.

Figure 5:
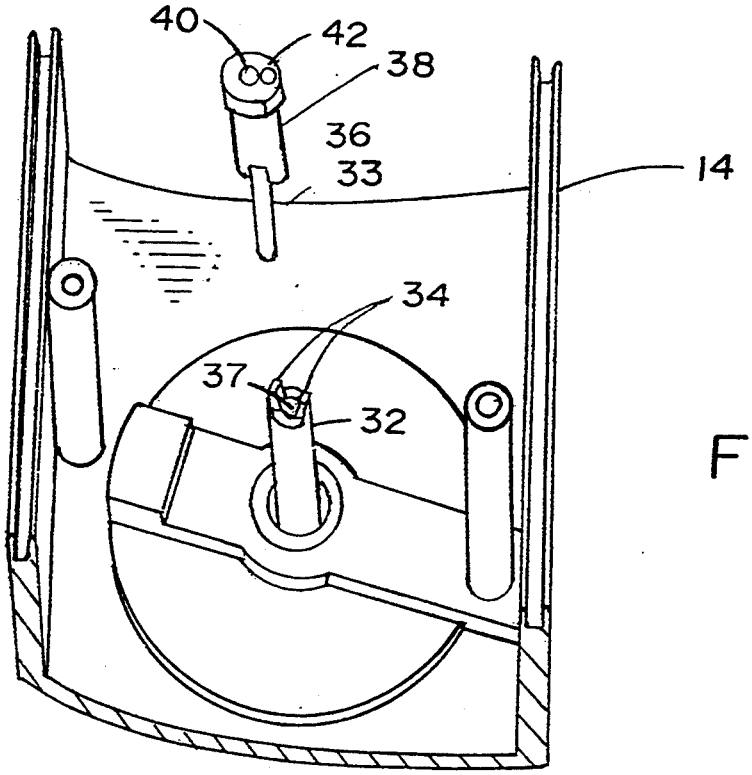
FIG. 5 is a view of a portion of the casing showing the stem of the switch and extension rod.

Referring to FIGS. 4 and 5 the complete actuator assembly includes the stem 32 of knob 12 which has an end with into two small projections 34 formed around a central hole 37. An extension rod 38 has an end 36 with two small projections which are received between projections 34 and engage stem 32. A central rod 33 slidably inserts into hole 37 and aligns extension rod 38 with stem 32. The opposite end of rod 38 has a small centrally positioned hole 40 and a smaller hole 42 located at the periphery of that end of rod 38. Hole 40 fits over a boss 27 and slidably receives cylindrical boss 27 on elongated plate 26. Hole 42 slidably receives boss 29. Boss 29 is located so that upon mining knob 12 and rod 38, boss 29 describes a semi-circular path. Due to the loose fit of opening 25 over linear switch actuator 28, elongated plate 26 translates this semi-circular motion into linear motion.

Since the center OFF position of the linear switch 22 is very tightly defined, slight variations in the positioning of either linear switch 22 and/or base 24 would force the linear switch actuator to rest in a position which is not truly its center OFF position. Moreover, there is often a slight variation from switch to switch in the center OFF position. Thus, the opening 25 in the elongated plate 26 is made larger than the linear switch actuator 28 and reliance is placed on the spring clip 46 (see FIGS. 6 and 7) to center the linear switch actuator 28. In operation, as the elongated plate 26 brings linear switch actuator 28 towards its center OFF position, it reaches a point which could be 5° on either side of the center OFF position at which spring clip 46 takes control of the movement of the linear switch actuator 28 and moves it to its center OFF position independently of further movement of linear switch actuator 28. Thus, during manufacture it is easy to cause the linear switch actuator 28 to find its true center OFF position regardless of tolerances by simply soldering a bottom edge of the spring clip 46 when the linear switch actuator 28 is in its true center OFF position.

If the looseness of the elongated plate opening 25 when over the linear switch actuator 28 were not present, it could be that the rotary knob 12 would have to be 2° or 3° to the left or right of its center position in order to move the linear switch actuator 28 to its center OFF position. However, once the knob 12 is close to its center OFF position, say within 5°, then the spring clip 46 takes over and returns the linear switch actuator 28 to its correct center OFF position.

Although switch 28 has three different positions, other linear switches with a different number of positions could easily be used. Similarly, rather than employing the dual holes 40 and 42 on the rod 38 and a boss 29 on the elongated plate 26 to move the elongated plate, one could use an elongated toothed edge on the elongated plate 26 and a gear on the rod 38.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modification or embodiments as fall within the true scope of the invention.

I claim:

1. A rotary switch, comprising a rotary actuator, a linear switch having a linear actuator, and a rotary to linear translator interconnecting said rotary actuator to said linear actuator such that rotation of said rotary actuator causes said translator to move linearly and move said linear actuator.

2. A rotary switch according to claim 1, wherein said rotary actuator includes a rotary switch knob and a rotary to linear actuator coupled to said knob at one end and to said rotary to linear translator at another end.

3. A rotary switch according to claim 2, wherein said rotary to linear translator is an elongated plate and includes a spring clip engaging said linear switch actuator and biasing it to a pre-selected position wherein the engagement of said linear actuator towards said preselected position, a point is reached at which said spring clip takes control of movement of the linear actuator and moves it to said preselected position.

4. A rotary switch according to claim 3, wherein said rotary to linear actuator includes a pin mounted in a fixed position, a rod coupled to said rotary knob at one end and having a pin receptacle at another end slidably receiving said pin so that upon rotation of said knob, said rod also rotates while maintaining alignment with said switch knob.

5. A rotary switch, comprising:

(a) a rotary actuator;

(b) a linear switch having a linear actuator;

(c) a rotary to linear translator interconnecting said rotary actuator and said linear actuator; and (d) a biasing spring coupled to said linear actuator for biasing said linear actuator to a preselected position such that upon movement towards said preselected position at a preset distance from said preselected position said biasing means takes over and moves said linear actuator to said preselected position;

wherein said translator is sufficiently loosely coupled to said linear actuator so that within said preset distance of said preselected position said biasing spring can move said linear actuator to said preselected position.

6. A rotary switch according to claim 5, wherein said rotary to linear translator is an elongated plate, one end of which fits loosely over said linear actuator so as to allow said biasing spring to move said linear actuator from said preset distance to said preselected position and another end of which couples to said rotary actuator so as to cause said elongated plate to move linearly in response to rotational movement of said rotary actuator.

7. A rotary switch according to claim 5, wherein said rotary actuator includes a rod having a central cylindrical hole and a peripheral hole and said rotary actuator further includes a fixed base with a cylindrical boss dimensioned to slidably insert into the central hole in said rod, an elongated plate having a peripheral boss located transverse to said central boss so as to slidably engage the peripheral hole of said rod, and wherein said elongated plate has an opening which fits loosely over said switch actuator and at another end, proximate to said peripheral boss, said elongated plate describing an eccentric path at an end coupled to said rod and a linear path at said linear actuator.

* * * * *